US011131160B2

(12) United States Patent
Sehsah et al.

(10) Patent No.: US 11,131,160 B2
(45) Date of Patent: Sep. 28, 2021

(54) SMART TUBULAR RUNNING MACHINE

(71) Applicant: Saudi Arabian Oil Company, Dhahran (SA)

(72) Inventors: Ossama Sehsah, Dhahran (SA); Mahmoud Adnan Alqurashi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 79 days.

(21) Appl. No.: 16/533,134

(22) Filed: Aug. 6, 2019

(65) Prior Publication Data

US 2021/0040806 A1 Feb. 11, 2021

(51) Int. Cl.

| | |
|---|---|
| ***E21B 23/00*** | (2006.01) |
| ***E21B 23/10*** | (2006.01) |
| ***E21B 47/12*** | (2012.01) |
| *E21B 23/01* | (2006.01) |

(52) U.S. Cl.

CPC ..... *E21B 23/10* (2013.01); *E21B 23/001* (2020.05); *E21B 47/12* (2013.01); *E21B 23/01* (2013.01)

(58) Field of Classification Search

CPC ..... E21B 43/10; E21B 23/10; E21B 47/12; E21B 23/01; E21B 23/001

See application file for complete search history.

(56) References Cited

U.S. PATENT DOCUMENTS

| | | | | |
|---|---|---|---|---|
| 4,676,310 | A * | 6/1987 | Scherbatskoy | E21B 47/00 340/853.4 |
| 6,378,627 | B1 * | 4/2002 | Tubel | E21B 17/1078 175/24 |
| 6,953,094 | B2 * | 10/2005 | Ross | E21B 23/00 166/381 |
| 7,096,977 | B2 | 8/2006 | Juhasz et al. | |
| 7,793,719 | B2 | 9/2010 | Snider et al. | |
| 8,356,674 | B2 | 1/2013 | Murray et al. | |
| 9,404,322 | B2 | 8/2016 | Wiedecke et al. | |
| 2008/0128128 | A1 * | 6/2008 | Vail | E21B 43/128 166/250.15 |
| 2008/0156477 | A1 | 7/2008 | Aivalis et al. | |
| 2011/0315451 | A1 | 12/2011 | Scott et al. | |
| 2012/0043071 | A1 | 2/2012 | Matherne et al. | |

(Continued)

FOREIGN PATENT DOCUMENTS

| | | |
|---|---|---|
| EP | 2696026 A1 | 2/2014 |
| WO | 0112946 A1 | 2/2001 |

OTHER PUBLICATIONS

International Search Report and Written Opinion for related PCT application PCT/US2020/045050 dated Oct. 7, 2020, pp. 1-14.

*Primary Examiner* — Brad Harcourt

(74) *Attorney, Agent, or Firm* — Bracewell LLP; Constance G. Rhebergen; Linda L. Morgan

(57) ABSTRACT

Systems and methods for delivering a tubular string into a subterranean well include a tubular running machine. The tubular running machine has a machine housing that includes a tubular member with a central bore. A turbine is located within the central bore of the machine housing. A control module is operable to provide energy and a communication signal to the turbine. A downhole connection assembly is located at a downhole end of the machine housing and is operable to releasably secure the tubular running machine to the tubular string.

19 Claims, 3 Drawing Sheets

(56) References Cited

U.S. PATENT DOCUMENTS

| | | | | |
|---|---|---|---|---|
| 2016/0177637 | A1 | 6/2016 | Fleckenstein et al. | |
| 2016/0251941 | A1* | 9/2016 | Murphree | E21B 41/00 166/387 |
| 2018/0128083 | A1 | 5/2018 | Lastra et al. | |
| 2019/0040703 | A1 | 2/2019 | Costa De Oliveira et al. | |

* cited by examiner

SMART TUBULAR RUNNING MACHINE

BACKGROUND OF THE DISCLOSURE

1. Field of the Disclosure

The disclosure relates generally to well completion operations in a subterranean well, and more particularly to moving tubular members within a subterranean well during completion operations.

2. Description of the Related Art

Oil wells typically have casing strings, liners and other tubular strings installed during well completion operations. The first casing string can be installed and suspended from the top of the well and has the largest diameter. A liner is generally understood to be a casing that does not extend to the top of the well. More than one liner as well as production tubing can be used to complete a well prior to producing fluids from the well.

After installation of the outermost casing a subsequent liner or tubular string is placed into the well by passing the subsequent liner or tubular string through the already installed first casing string. As the subsequent section of liner or other tubular string is positioned in the well it is typically sealed and suspended to the already installed casing string or other outer tubular member by way of a hanger assembly.

In currently available systems liners and other tubular strings are lowered into the well by making up sufficient joints of drill string or other pipe members with a running tool to lower the liners or other tubular string members to the desired well depth, where it is landed in the hanger assembly. A number of joints of drill string or other pipe members would be required to reach the desired depth and each time a new joint is added, the liner or other tubular string member sits static within the wellbore. After the liners or other tubular string members are landed downhole the running tool is released from the liner or other tubular string members and returned to the surface by pulling the joints of drill string or other pipe members out of the well, separating the joints as each joint reaches the surface.

SUMMARY OF THE DISCLOSURE

Systems and methods of this disclosure allow for the running of liners or other tubular strings downhole to a desired depth of the wellbore in a controlled speed without stopping. Frequent stops during installation of the liner or other tubular strings can be eliminated, which in turn reduces the risk of the liner or other tubular string of getting differentially stuck when the liner or other tubular string is static. The liner or other tubular string can be run into the well at a generally constant speed and monitored remotely.

Embodiments of this disclosure provide a remote system for installation of the liner or other tubular string. A remote installation system allows for operators to perform different tasks at the surface while the liner or other tubular string is being run, instead of requiring the operators to make up joints of drill string or other running string for lowering the liner to the desired depth. A turbine can be part of a smart tubular running machine that can control the speed of descent of the liner or other tubular member, either providing propulsion to maintain the speed of the liner or other tubular member, or by slowing down the descent to avoid buckling of the liner or other tubular member. In order to retrieve the smart tubular running machine or if it is desired to return the liner or other tubular string to the surface, the direction of the turbine can be reversed or a retrieval means can be connected to an uphole connection mechanism to pull the smart tubular running machine or pull the liner or other tubular string from the well.

In an embodiment of this disclosure a system for delivering a tubular string into a subterranean well includes a tubular running machine, the tubular running machine having a machine housing, the machine housing including a tubular member with a central bore. A turbine is located within the central bore of the machine housing. A control module is operable to provide energy and a communication signal to the turbine. A downhole connection assembly is located at a downhole end of the machine housing and operable to releasably secure the tubular running machine to the tubular string.

In alternate embodiments, the control module can be located within a sidewall of the machine housing. The downhole connection assembly can include a flow port, the flow port defining a fluid flow path from exterior of the machine housing to the turbine.

In other alternate embodiments, the system can further include an uphole connection mechanism, the uphole connection mechanism located at an uphole end of the machine housing. The uphole connection mechanism can be attached only to the uphole end of the machine housing during delivery of the tubular string into the subterranean well. Alternately, the uphole connection mechanism is selectively securable to a retrieval system. The turbine can be operable to rotate in a first direction propelling the tubular running machine in a downhole direction, and is operate to rotate in a second direction propelling the tubular running machine in an uphole direction. The control module includes a programmable logic controller. The downhole connection assembly can include a latching sub and a connector sub, where the latching sub is located between the machine housing and the connector sub, is fixed to the machine housing, and is releasably secured to the tubular string.

In an alternate embodiment of this disclosure, a method for delivering a tubular string into a subterranean well includes providing a tubular running machine. The tubular running machine has a machine housing, the machine housing including a tubular member with a central bore. A turbine is located within the central bore of the machine housing. A control module is operable to provide energy and a communication signal to the turbine. A downhole connection assembly is located at a downhole end of the machine housing and operable to releasably secure the tubular running machine to the tubular string. The tubular running machine is releasably secured to the tubular string. The tubular running machine and the tubular string is delivered into a wellbore of the subterranean well. The turbine is operated to control the rate of speed of the movement of the tubular string within the wellbore.

In alternate embodiments, the control module can be located within a sidewall of the machine housing and the method can include signaling the turbine with the control module to select the rate of rotation and the direction of rotation of the turbine. The method can further include providing a fluid flow path from exterior of the machine housing to the turbine with a flow port that extends through the downhole connection assembly.

In other alternate embodiments, an uphole connection mechanism can be located at an uphole end of the machine housing, and the method can further include attaching the uphole connection member only to the uphole end of the machine housing during delivery of the tubular string into the subterranean well. The method can further include securing the uphole connection mechanism to a retrieval system for retrieving the tubular running machine from the wellbore.

In yet other alternate embodiments, the method can further include rotating the turbine in a first direction to propel the tubular running machine in a downhole direction, and rotating the turbine in a second direction to propel the tubular running machine in an uphole direction. Alternately, the control module can include a programmable logic controller, and the method can further include providing communication between the wellbore and a location outside of the wellbore with the programmable logic controller.

In still other alternate embodiments, the control module can include a programmable logic controller, and the method can further include activating an anchor assembly with the programmable logic controller, the anchor assembly sealingly securing the tubular string within the wellbore. The downhole connection assembly can include a latching sub and a connector sub, where the latching sub is located between the machine housing and the connector sub, is fixed to the machine housing, and is releasably secured to the connector sub, the method further including retaining the connector sub with the tubular string when the tubular running machine is retrieved from the wellbore.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
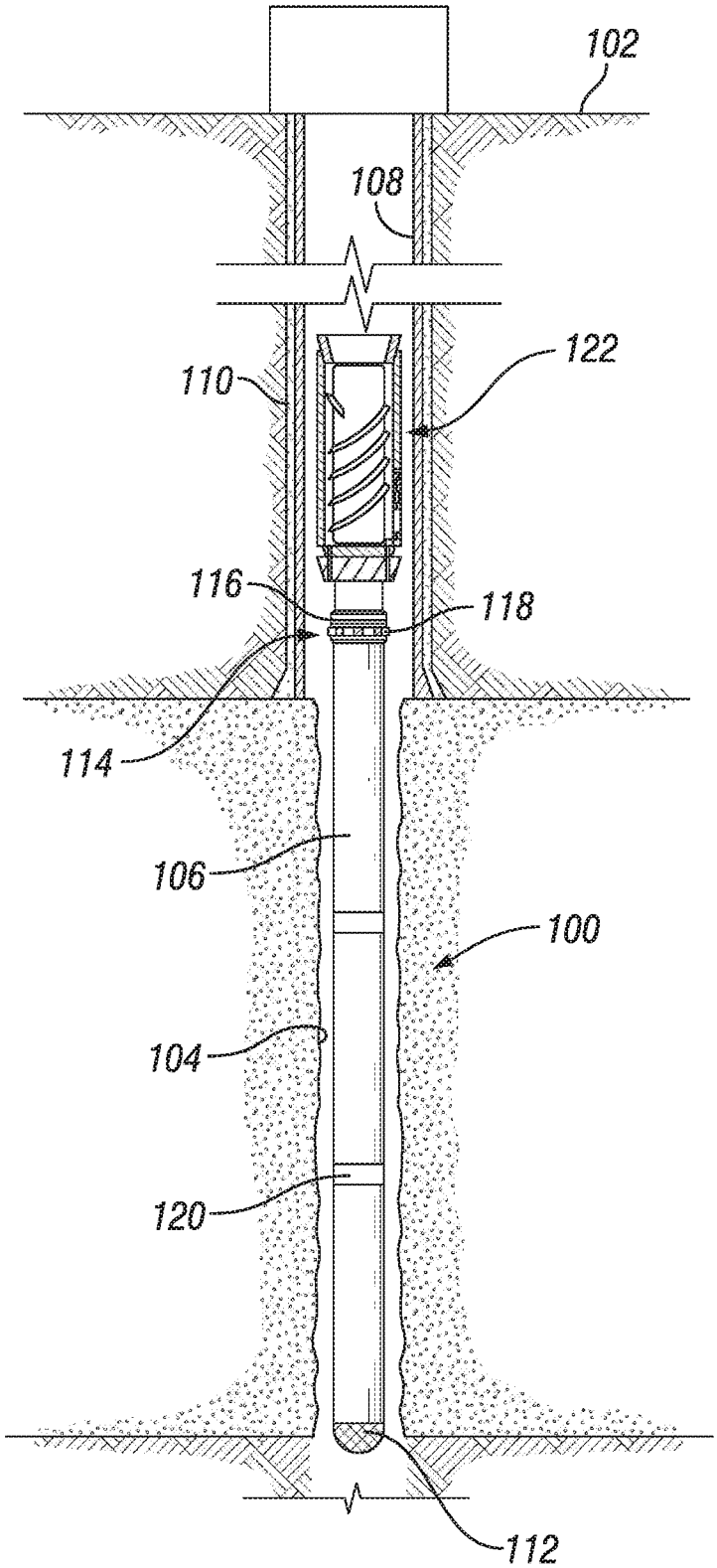
FIG. 1 is a schematic sectional representation of a subterranean well having a system for delivering a tubular string into a subterranean well, in accordance with an embodiment of this disclosure, shown with a tubular running machine releasably attached to the tubular string.

Referring to FIG. 1, subterranean well 100 extends downwards from a surface 102 of the earth, which can be a ground level surface or a subsea surface. Wellbore 104 of subterranean well 100 can be extended generally vertically relative to the surface. Wellbore 104 can alternately include portions that extend generally horizontally or in other directions that deviate from generally vertically from the surface. Subterranean well 100 can be a well associated with hydrocarbon development operations, such as a hydrocarbon production well, an injection well, or a water well.

Tubular string 106 is shown within wellbore 104. Tubular string 106 can be, for example, a liner, a production tubular, or other elongated string member known within the industry that extends into wellbore 104 of subterranean well 100. Wellbore 104 can be an uncased opening. In embodiments where tubular string 106 is an inner tubular member, wellbore 104 can be defined within an outer tubular member, such as a casing 108 that is cemented into place with cement 110.

Tubular string 106 can include downhole tools and equipment that are secured in line with joints of tubular string 106. Tubular string 106 can have, for example, shoe 112. Shoe 112 can be located at a downhole end of tubular string 106 and guide tubular string 106 within wellbore 104. Shoe 112 can have a rounded surface for directing the downhole end of tubular string past ledges, protrusions, and other obstructions within wellbore 104.

Tubular string 106 can further include anchor assembly 114. Anchor assembly 114 can include features that allow tubular string 106 to seal against, and be suspended at a downhole end of casing 108. As an example, anchor assembly 114 can include packer member 116 and anchor member 118. In embodiments where tubular string 106 is a liner that is to be cemented in place, tubular string 106 can further include traditional cementing collar 120, which can be, for example, a float collar, a landing collar or stop collar.

In the embodiment of FIG. 1, tubular string 106 is being delivered into wellbore 104 with smart tubular running machine 122. Smart tubular running machine 122 is remotely operated and can deliver tubular string 106 to a desired depth within wellbore 104 without smart tubular running machine 122 being mechanically secured to a member that reaches to the surface.

Figure 2:
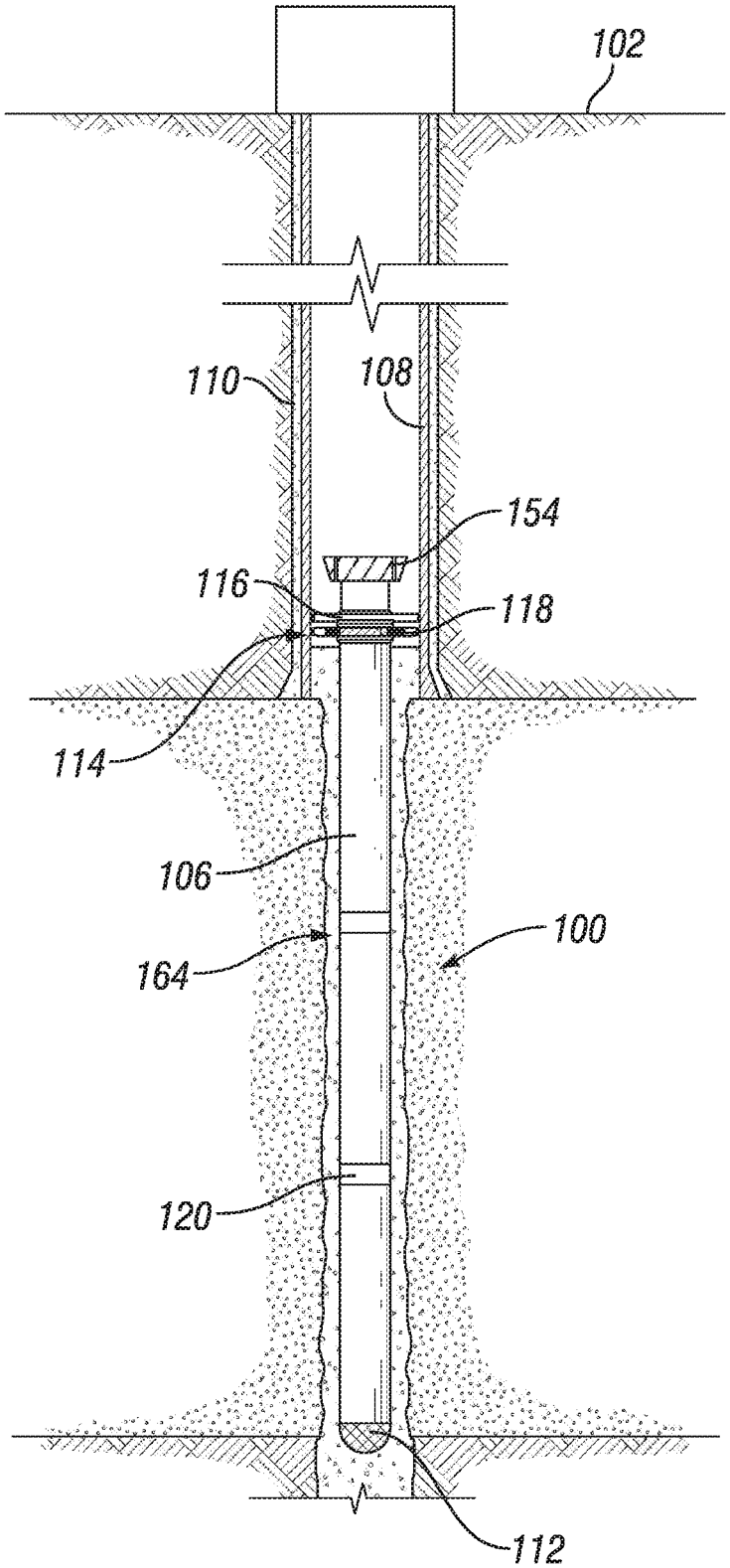
FIG. 2 is a schematic sectional representation of a subterranean well having a tubular string landed in a subterranean well, in accordance with an embodiment of this disclosure.

Looking at FIG. 2, after tubular string 106 has been delivered to a desired depth within wellbore 104 and secured in place, tubular running machine 122 can be returned to the surface, leaving tubular string 106 and a connector sub of tubular running machine 122 within wellbore 104.

Figure 4:
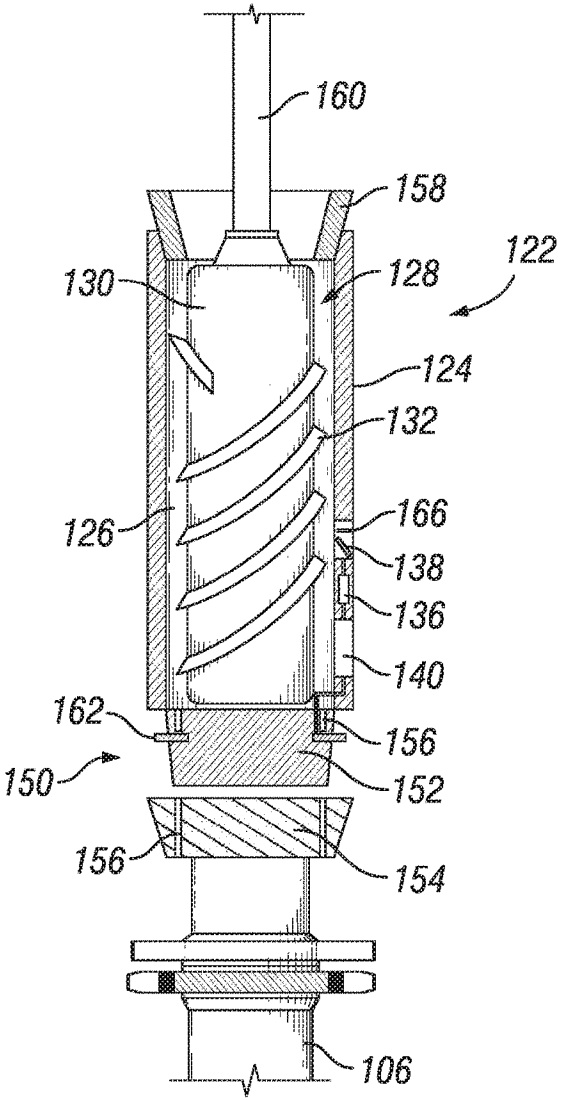
FIG. 4 is schematic view of a tubular running machine, in accordance with an embodiment of this disclosure, shown with the tubular running machine detached from the tubular string.
Figure 3:
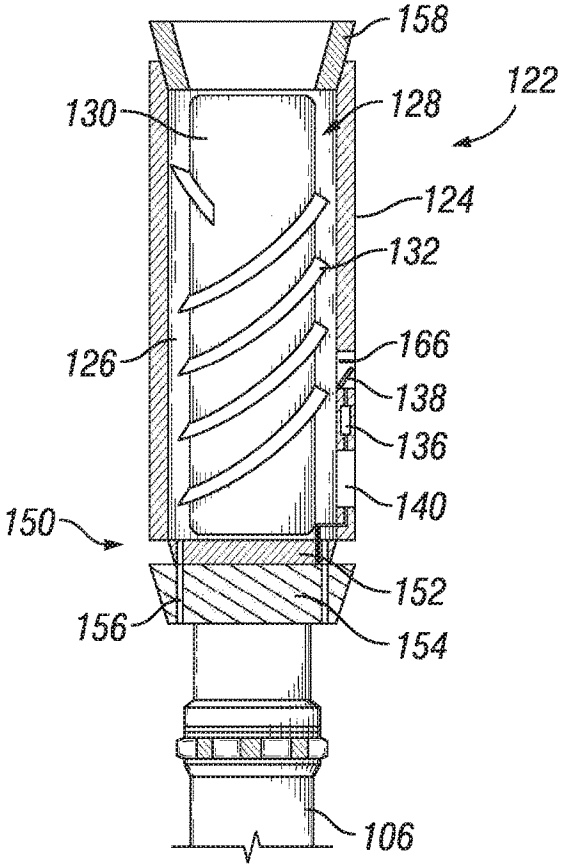
FIG. 3 is schematic section view of a tubular running machine, in accordance with an embodiment of this disclosure, shown with the tubular running machine releasably attached to the tubular string.

Looking at FIGS. 3-4, tubular running machine 122 includes machine housing 124. Machine housing 124 can include a generally tubular member with central bore 126. Tubular running machine 122 can have a diameter in a range of 4½ to 13⅜ inches.

Turbine 128 is located within central bore 126 of machine housing 124. Turbine 128 can be operated to control the rate of speed of the movement of tubular string 106 within wellbore 104. Turbine 128 can provide sufficient force and speed to run tubular string 106 to the bottom of wellbore 104 or alternately to the desired depth for placement of tubular string 106 within wellbore 104. If tubular string 106 is traveling too quickly within wellbore 104, turbine 128 can be used to reduce the speed of tubular string 106 and control the descent of tubular string 106 within wellbore 104. In an example embodiment, turbine 128 can generate electricity to be used as source of power for motion of tubular string 106.

Turbine 128 includes hub 130. Hub 130 is a generally cylindrical member located co-axially within machine housing 124. Blades 132 are located on an outer surface of hub 130.

When tubular string 106 and tubular running machine 122 are moving in a downhole direction turbine 128 can rotate in a first direction to provide propulsion to tubular string 106. When tubular string 106 and tubular running machine 122 together, or tubular running machine 122 alone are to be returned to the surface, turbine 128 can rotate in a second direction to propel tubular running machine 122 in an uphole direction. Turbine 128 can used the stored energy from having generated energy to rotate in the second direction and move uphole.

Fluid located within central bore 126 of machine housing 124 can travel in the annular space between an outer surface of turbine 128 and an inner surface of central bore 126. This fluid within central bore 126 interacts with blades 132 to provide the propulsion forces.

Control module 134 can store energy in power storage module 166 and can provide a communication signal to turbine 128. In the example embodiments control module 134 is located within a sidewall of machine housing 124. Being located within the sidewall of machine housing 124 would limit the interference of control module 134 with operations within central bore 126, in the case where control module 134 was instead located within central bore 126. Being located within the sidewall of machine housing 124 would also limit the interference of control module 134 with operations within wellbore 104, in the case where control module 134 was instead located on an outer surface of machine housing 124.

Looking at FIG. 4, control module 134 can include programmable logic controller 136. Control module 134 can manipulate the motion of turbine 128 to control the deployment speed of tubular string 106. Control module 134 can further manage and control the release of tubular running machine 122 from tubular string 106 when tubular string 106 reaches the desired depth. Control module 134 can provide the energy required to both activate the release mechanism and to set the anchor assembly 114 of tubular string 106.

Programmable logic controller 136 can be preprograme with preset parameters that are defined for each job. Programmable logic controller 136 can, for example, signal turbine 128 to select the rate of rotation and the direction of rotation of turbine 128. Programmable logic controller 136 can send commands to turbine 128 so that turbine 128 generates the required speed and feeds the energy to turbine 128. Programmable logic controller 136 can further communicate wirelessly with an operator at an earth's surface to confirm the position and status of the operations of tubular running machine 122. As an example, programmable logic controller 136 can be preprogrammed with a target speed of descent. After tubular running machine 122 is released from the surface, the speed of decent of tubular running machine 122 and tubular string 106 can be monitored. If the speed of tubular running machine 122 is faster than the target range of speed, programmable logic controller 136 can provide a command to turbine 128 to slow the descent of tubular running machine 122. If the speed of tubular running machine 122 is slower than the target range of speed, programmable logic controller 136 can provide a command to turbine 128 to speed up the descent of tubular running machine 122.

Control module 134 will have sufficient energy stored to complete the installation of tubular string 106 within wellbore 104 and any other activities that tubular running machine 122 has been programed to perform. Alternately, control module can utilize the energy of fluid flowing through central bore 126 to generate additional energy while tubular running machine 122 is located within wellbore 104.

When the desired depth within wellbore 104 has been reached, programmable logic controller 136 can be programmed to actuate anchor assembly 114 to sealingly secure tubular string 106 within wellbore 104. Anchor assembly 114 can include a tubing hanger. After tubular running machine 122 has reached the desired depth, programmable logic controllers 136 can instruct regulator 138 to operate hydraulic chamber 140 of control module 134 to provide sufficient pressure to expand anchor assembly 114 against casing 108. Anchor assembly 114 can support the weight of tubular string 106 during the completion operations of subterranean well 100. After anchor assembly 114 has been expanded to secure tubular string 106 within wellbore 104, programmable logic controller 136 can then be directed to release connector sub 154 so that tubular string 106 is released from tubular running machine 122. Programmable logic controller 136 can be instructed wirelessly from earth's surface 102 to release connector sub 154.

In addition to being programmed to maneuver tubular string 106 within wellbore 104 and secure tubular string 106 within wellbore 104, programmable logic controller 136 can be programmed to then release tubular running machine 122 from tubular string 106. Programmable logic controller 136 can communicate with a location outside of wellbore 104, such as the surface, wirelessly to confirm the position and status of tubular running machine 122 throughout the operation of tubular running machine 122 within wellbore 104.

Programmable logic controller 136 can navigate tubular running machine 122 using an autonomous system based on a preplanned sequence.

Tubular running machine 122 further includes downhole connection assembly 150. Downhole connection assembly 150 is located at a downhole end of machine housing 124. Downhole connection assembly 150 can releasably secure tubular running machine 122 to tubular string 106. Downhole connection assembly 150 can include latching sub 152 and connector sub 154.

Latching sub 152 is located between machine housing 124 and connector sub 154. Latching sub 152 can be a generally disk shaped member that has a tapered or generally frusto conical outer surface shape. Latching sub 152 is fixed to machine housing 124. Latching sub 152 can be integral with machine housing 124 or otherwise made part of tubular running machine 122 so that latching sub 152 remains fixed to machine housing 124 after tubular string 106 is released from tubular running machine 122.

Latching sub 152 can be the neck between tubular string 106 and machine housing 124. Latching sub 152 can withstand the weight of tubular string 106 when making up tubular string 106 at the surface. Latching sub 152 and connector sub 154 are releasable secured together so that latching sub 152 can be released from connector sub 154. As an example, latching sub 152 can be releasably secured to connector sub 154 with pins 162 (FIG. 4). Pins 162 can be pressure rated pins. In certain embodiments, pins 162 can be sheared after anchor assembly 114 has been expanded to secure tubular string 106 within wellbore 104. In alternate embodiments, programmable logic controller 136 can direct the retraction of pins 162 to release latching sub 152 from connector sub 154.

Connector sub 154 can be fixed to tubular string 106 so that when latching sub 152 is released from connector sub 154, latching sub 152 is no longer mechanically connected to tubular string 106 and connector sub remains secured to tubular string 106. As an example, connector sub 154 can be threaded to an uphole end of tubular string 106. Because connector sub 154 is retained with tubular string 106, connector sub 154 remains within wellbore 104 when tubular running machine 122 is retrieved from wellbore 104. Connector sub 154 can be a generally disk shaped member that has a tapered or generally frusto conical outer surface shape.

Downhole connection assembly 150 further includes flow port 156. Flow port 156 defines a fluid flow path from exterior of machine housing 124 to turbine 128. Flow port 156 extends axially through connector sub 154 from a downhole end of connector sub 154 to an opposite end of connector sub 154. Flow port 156 further extends axially through latching sub 152 from a downhole end of latching sub 152 to an uphole end of latching sub 152. Flow port 156 of connector sub 154 is aligned with flow port 156 of latching sub 152. Flow port 156 in this way provides a fluid flow path from exterior of machine housing 124 through connector sub 154 and latching sub 152 to central bore 126 of machine housing 124. After passing through machine housing 124, the fluid flow can exit machine housing 124 through a central bore of uphole connection mechanism 158.

Uphole connection mechanism 158 of tubular running machine 122 is located at an uphole end of machine housing 124. Uphole connection mechanism 158 can be a generally ring shaped member that has a tapered or generally frusto conical outer surface shape. Uphole connection mechanism 158 is integrally formed with, or secured at, an uphole end of machine housing 124. In certain embodiments a downhole end of uphole connection mechanism 158 is attached to machine housing 124 and an uphole end of uphole connection mechanism 158 is not attached to any wire, cable, tubular, or other member that extends from the surface to tubular running machine 122. Instead tubular running machine 122 is a remotely operated system that requires no deployment string from the surface for delivering tubular string 106 to the desired depth within wellbore 104.

In order to pull tubular running machine 122 alone or pull tubular running machine and tubular string 106 from wellbore 104, uphole connection system can be secured to a retrieval system 160. Retrieval system 160 can be, for example, a tubular string, coil tubing, wireline, or cable that can engage uphole connection mechanism 158 for retrieving tubular running machine 122.

Alternately, in order to pull tubular running machine 122 alone or pull tubular running machine and tubular string 106 from wellbore 104 turbine 128 can rotate in the second direction to propel tubular running machine 122 in an uphole direction for self-retrieval. If self-retrieval is desired, then programmable logic controller 136 can be programmed to instruct turbine 128 to rotate in the second direction. In order for self-retrieval to be successful, control module 134 will need to have sufficient energy stored to propel tubular running machine 122 back to the surface. Before or during the self-retrieval operation, programmable logic controller 136 can communicate downhole conditions within wellbore 104 and communicate the amount of stored energy to the surface so that an operator can confirm that a self-retrieval operation can be successful.

In an example of operation, in order to deliver tubular string 106 into a subterranean well tubular running machine 122 can be releasably secured to an uphole end of tubular string 106. Tubular string 106 and tubular running machine 122 can be delivered into wellbore 104 of subterranean well 100. Programmable logic controller 136 of control module 134 can be programmed to maneuver tubular string 106 within wellbore 104 and secure tubular string 106 within wellbore 104. If tubular string 106 is a liner or casing and requires cement 164 (FIG. 2) or a pump treatment, a running tool with a connector sub can be run to perform such operation.

Programmable logic controller 136 can also be programmed to then release tubular running machine 122 from tubular string 106. Programmable logic controller 136 can then be programed to reverse turbine 128 to that turbine 128 propels tubular running machine 122 back to the surface.

Embodiment of this disclosure therefore provides systems and methods for running a tubular into a wellbore more quickly than some currently available methods. Operators can perform other work while the smart tubular running machine remotely delivers the tubular into the wellbore, increasing overall operational efficiency. Because the smart tubular running machine can maintain a generally constant movement of the tubular, the risk of differential sticking is minimized. The risk associated with manually making up a string for delivering the tubular downhole is mitigated with systems and methods of this disclosure Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for delivering a tubular string into a subterranean well, the system including:

a tubular running machine, the tubular running machine having:

a machine housing, the machine housing including a tubular member with a central bore;

a turbine located within the central bore of the machine housing;

a control module, the control module operable to provide energy and a communication signal to the turbine; and a downhole connection assembly, the downhole connection assembly located at a downhole end of the machine housing and releasably securing the tubular running machine to an uphole end of the tubular string; where the tubular string is operable to be landed in the subterranean well for producing fluids from the subterranean well; and the tubular running machine is operable to be remotely operated to deliver the tubular string to a desired depth within the subterranean well with the smart tubular running machine being free of mechanical connection to any member that reaches to the surface.

2. The system of claim 1, where the control module is located within a sidewall of the machine housing.

3. The system of claim 1, where the downhole connection assembly includes a flow port, the flow port defining a fluid flow path from exterior of the machine housing to the turbine.

4. The system of claim 1, further including an uphole connection mechanism, the uphole connection mechanism located at an uphole end of the machine housing.

5. The system of claim 4, where the uphole connection mechanism is attached only to the uphole end of the machine housing during delivery of the tubular string into the subterranean well.

6. The system of claim 4, where the uphole connection mechanism is selectively securable to a retrieval system.

7. The system of claim 1, where the turbine is operable to rotate in a first direction propelling the tubular running machine in a downhole direction and is operate to rotate in a second direction propelling the tubular running machine in an uphole direction.

8. The system of claim 1, where the control module includes a programmable logic controller.

9. The system of claim 1, where the downhole connection assembly includes a latching sub and a connector sub, where the latching sub is located between the machine housing and the connector sub, is fixed to the machine housing, and is releasably secured to the tubular string.

10. A method for delivering a tubular string into a subterranean well, the system including:

providing a tubular running machine, the tubular running machine having:

a machine housing, the machine housing including a tubular member with a central bore;

a turbine located within the central bore of the machine housing;

a control module, the control module operable to provide energy and a communication signal to the turbine; and a downhole connection assembly, the downhole connection assembly located at a downhole end of the machine housing and operable to releasably secure the tubular running machine to the tubular string;

providing a fluid flow path from exterior of the machine housing to the turbine with a flow port that extends through the downhole connection assembly;

releasably securing the tubular running machine to an uphole end of the tubular string, where the tubular string is operable to be landed in the subterranean well for producing fluids from the subterranean well;

delivering the tubular running machine and the tubular string into a wellbore of the subterranean well; and operating the turbine to control the rate of speed of the movement of the tubular string within the wellbore.

11. The method of claim 10, where the control module is located within a sidewall of the machine housing and the method includes signaling the turbine with the control module to select the rate of rotation and the direction of rotation of the turbine.

12. The method of claim 10, further including an uphole connection mechanism, the uphole connection mechanism located at an uphole end of the machine housing, the method further including attaching the uphole connection member only to the uphole end of the machine housing during delivery of the tubular string into the subterranean well.

13. The method of claim 10, further including an uphole connection mechanism, the uphole connection mechanism located at an uphole end of the machine housing, the method further including securing the uphole connection mechanism to a retrieval system for retrieving the tubular running machine from the wellbore.

14. The method of claim 10, where the method further includes rotating the turbine in a first direction to propel the tubular running machine in a downhole direction, and rotating the turbine in a second direction to propel the tubular running machine in an uphole direction.

15. The method of claim 10, where the control module includes a programmable logic controller, and the method further includes providing communication between the wellbore and a location outside of the wellbore with the programmable logic controller.

16. The method of claim 10, where the control module includes a programmable logic controller, and the method further includes activating an anchor assembly with the programmable logic controller, the anchor assembly sealingly securing the tubular string within the wellbore.

17. The method of claim 10, where the downhole connection assembly includes a latching sub and a connector sub, where the latching sub is located between the machine housing and the connector sub, is fixed to the machine housing, and is releasably secured to the connector sub, the method further including retaining the connector sub with the tubular string when the tubular running machine is retrieved from the wellbore.

18. A method for delivering a tubular string into a subterranean well, the system including:

providing a tubular running machine, the tubular running machine having:

a machine housing, the machine housing including a tubular member with a central bore;

a turbine located within the central bore of the machine housing;

a control module, the control module operable to provide energy and a communication signal to the turbine; and a downhole connection assembly, the downhole connection assembly located at a downhole end of the machine housing and operable to releasably secure the tubular running machine to the tubular string;

releasably securing the tubular running machine to the tubular string;

delivering the tubular running machine and the tubular string into a wellbore of the subterranean well; and operating the turbine to control the rate of speed of the movement of the tubular string within the wellbore; where the method further includes providing a fluid flow path from exterior of the machine housing to the turbine with a flow port that extends through the downhole connection assembly.

19. A method for delivering a tubular string into a subterranean well, the system including:

providing a tubular running machine, the tubular running machine having:

a machine housing, the machine housing including a tubular member with a central bore;

a turbine located within the central bore of the machine housing;

a control module, the control module operable to provide energy and a communication signal to the turbine; and a downhole connection assembly, the downhole connection assembly located at a downhole end of the machine housing and operable to releasably secure the tubular running machine to the tubular string;

releasably securing the tubular running machine to the tubular string;

delivering the tubular running machine and the tubular string into a wellbore of the subterranean well; and operating the turbine to control the rate of speed of the movement of the tubular string within the wellbore; where the downhole connection assembly includes a latching sub and a connector sub, where the latching sub is located between the machine housing and the connector sub, is fixed to the machine housing, and is releasably secured to the connector sub, the method further including retaining the connector sub with the tubular string when the tubular running machine is retrieved from the wellbore.

* * * * *